US010941027B2

(12) United States Patent
Stolten

(10) Patent No.: US 10,941,027 B2
(45) Date of Patent: Mar. 9, 2021

(54) LIFTING DEVICE FOR AN INDUSTRIAL TRUCK AS WELL AS AN INDUSTRIAL TRUCK OF THIS TYPE

(71) Applicant: Jungheinrich Aktiengesellschaft, Hamburg (DE)

(72) Inventor: Thomas Stolten, Tremsbüttel (DE)

(73) Assignee: Jungheinrich Aktiengesellschaft, Hamburg (DE)

( * ) Notice: Subject to any disclaimer, the term of this patent is extended or adjusted under 35 U.S.C. 154(b) by 208 days.

(21) Appl. No.: 15/843,255

(22) Filed: Dec. 15, 2017

(65) Prior Publication Data

US 2018/0170732 A1 Jun. 21, 2018

(30) Foreign Application Priority Data

Dec. 15, 2016 (DE) ..... 10 2016 124 504.6

(51) Int. Cl.
*B66F 9/22* (2006.01)
*B66F 9/20* (2006.01)

(52) U.S. Cl.
CPC ..... *B66F 9/22* (2013.01); *B66F 9/205* (2013.01); *F15B 2211/4053* (2013.01); *F15B 2211/71* (2013.01)

(58) Field of Classification Search
CPC ..... B66F 9/22; B66F 9/205; F15B 2211/7128
See application file for complete search history.

(56) References Cited

U.S. PATENT DOCUMENTS 3,871,266 A * 3/1975 Schwab ..... B66F 9/22 91/517
4,593,791 A * 6/1986 Matthews ..... B66F 9/08 187/224
7,240,771 B2 * 7/2007 Perkins ..... B66F 9/22 187/226
2007/0205056 A1 * 9/2007 Rekow ..... B66F 9/07545 187/226
2013/0277584 A1 * 10/2013 McKernan ..... B66F 9/22 251/129.01
2019/0084816 A1 * 3/2019 Stolten ..... B66F 9/22

FOREIGN PATENT DOCUMENTS

DE 102009011865 A1 9/2010
EP 1593645 A2 9/2005
EP 1600420 A1 11/2005
(Continued)

OTHER PUBLICATIONS

EP 17207700; filed Dec. 15, 2017; European Office Action dated Feb. 22, 2019; 6 pages.

(Continued)

*Primary Examiner* — Minh Truong
(74) *Attorney, Agent, or Firm* — Barclay Damon LLP

(57) ABSTRACT

A lifting device for an industrial truck comprises a lift frame with a moveably guided load carrier and at least one moveably guided mast stage. A free lift cylinder is configured to actuate the load carrier and at least one mast lift cylinder is configured to actuate the at least one mast stage. A hydraulic assembly supplies the free lift cylinder and the at least one mast lift cylinder with hydraulic fluid and further comprises at least one delivery valve and at least one recirculating valve.

16 Claims, 11 Drawing Sheets

(56) References Cited

FOREIGN PATENT DOCUMENTS

| | | | |
|---|---|---|---|
| EP | 2465812 | A1 | 6/2012 |
| EP | 2508464 | A2 | 10/2012 |
| EP | 2508465 | A1 | 10/2012 |
| EP | 2636637 | A1 | 9/2013 |
| EP | 2985473 | A1 | 2/2016 |
| WO | 2009/141242 | A1 | 11/2009 |

OTHER PUBLICATIONS

EP 17207700; filed Dec. 15, 2017; European Search Report dated Apr. 18, 2018; 3 pages.

* cited by examiner

LIFTING DEVICE FOR AN INDUSTRIAL TRUCK AS WELL AS AN INDUSTRIAL TRUCK OF THIS TYPE

CROSS REFERENCE TO RELATED INVENTION

This application is based upon and claims priority to, under relevant sections of 35 U.S.C. § 119, German Patent Application No. 10 2016 124 504.6, filed Dec. 15, 2016, the entire contents of which are hereby incorporated by reference.

BACKGROUND

The invention relates to a lifting device for an industrial truck and to an industrial truck having a lifting device according to the invention.

Industrial trucks for moving loads in and out of storage usually have a lift frame with a mast and a load carrier. The mast can consist of multiple mast stages, which move apart from each other telescopically when the mast is extended. Each stage of the mast is normally moved by a hydraulic cylinder. The extending of the mast is also called mast lift. The load carrier is usually connected to the uppermost mast stage and serves to receive and carry loads. The load carrier is likewise moved along the so-called free lift by a hydraulic cylinder. At the start of a lifting operation, the free lift generally extends first. In the process, only the load carrier is raised without extending the mast. In this way, the load carrier and thus the load can be raised without increasing the overall height of the lift frame and the vertical clearance of the industrial truck. If the load carrier is fully extended and the free lift has thus reached its end position, then the mast lift begins, and the individual mast stages of the mast are extended.

The lifting sequence of free lift and mast lift is most often controlled by the area ratios of the hydraulic cylinders driving the load carrier and/or the mast stages. The area ratios of the hydraulic cylinder are configured such that the hydraulic pressure required to lift the free lift cylinder is lower than the hydraulic pressure required to lift the mast lift cylinder. Accordingly, the load carrier always initially extends in accordance with the free lift during a lifting operation. Only once the free lift is finished (i.e., the free lift cylinder has reached its end position) does the mast lift begin. During the lowering process, the disadvantage arises that the hydraulic pressure in the free lift is so low when there is little or no load that the load carrier can be lowered only at a low speed. The lowering speed of the load carrier is significantly lower here than the lowering speed of the mast stages of the lift mast. Additionally, increased flow resistances can occur in the hydraulic lines and mechanical friction losses can occur in the cylinders when hydraulic pressure is too low. This leads to a further reduction in lowering speed and thus to reduced handling capacity by the industrial truck.

To increase the lowering speed in the free lift when there is little or no load, the effective piston surface of the free lift cylinder can be reduced. Doing so raises the hydraulic pressure, and the lowering speed of the load carrier is increased. A disadvantage of this solution is that it is no longer possible to utilize the area ratios to control the lifting sequence and lowering sequence, since the pressure difference along the individual lifting stages is too small or even reverses.

Hydraulic controls are known from DE 10 2009 011 865 A1 and EP 1593645 A2 which permit a targeted supply of the mast lift cylinder and free lift cylinder of an industrial truck independently of the piston surface of the cylinder. For this purpose, the supply of hydraulic fluid to the hydraulic cylinder is controlled by a plurality of hydraulic valves. Document EP 1593645 A2 discloses the complicated use of two separate 3/3-way proportional valves to supply the free lift cylinder and the mast lift cylinder. To supply the mast lift cylinder and free lift cylinder, DE 10 2009 011 865 A1 provides one 3/3-way proportional valve and two 2/2-way proportional valves or one 2/3-way proportional valve and one 3/3-way proportional valve. The lifting devices described in the cited documents are complicated and exhibit an unfavorable energy balance.

BRIEF SUMMARY OF THE INVENTION

The object of the invention is therefore to provide a lifting device for an industrial truck that is simpler and more efficient.

In an embodiment, a lifting device for an industrial truck comprises a lift frame with a moveably guided load carrier and at least one moveably guided mast stage. A free lift cylinder is configured to actuate the load carrier and at least one mast lift cylinder configured to the at least one mast stage. The lifting device further comprises a hydraulic assembly configured to provide the free lift cylinder and the at least one mast lift cylinder with hydraulic fluid. In an embodiment, the lifting device comprises at least one delivery valve, which is connected to the hydraulic assembly and to the free lift cylinder and/or the at least one mast lift cylinder and which is configured to only supply hydraulic fluid from the hydraulic assembly to the free lift cylinder and/or the mast lift cylinder. The lifting device may further comprise a recirculation valve, which is connected to the hydraulic assembly and to the free lift cylinder and/or the at least one mast lift cylinder. The recirculation valve is configured to recirculate hydraulic fluid from the free lift cylinder and/or the mast lift cylinder back to the hydraulic assembly.

In an embodiment, the lifting device comprises at least two separate valves, namely a delivery valve and a recirculation valve. The delivery valve and the recirculation valve are not the same valve. The delivery valve is configured to regulate the supply of hydraulic fluid from the hydraulic assembly to the free lift cylinder and/or the mast lift cylinder. When hydraulic fluid is supplied from the hydraulic assembly to the free lift cylinder, the load carrier and thus any load on the load carrier are raised. The free lift is carried out in this way. When hydraulic fluid is supplied to the mast lift cylinder, the at least one mast stage is extended and the mast lift is thereby carried out. By extending the at least one mast stage, the load carrier with the load is likewise raised. To lower the load carrier and thus the load that is located on the load carrier, the at least one mast lift cylinder and/or free lift cylinder are retracted. To do so, hydraulic fluid is conducted from the corresponding cylinder back into the hydraulic assembly. This recirculation of hydraulic fluid does not take place through the delivery valve. Instead, the hydraulic fluid to be recirculated flows through the at least one recirculation valve into the hydraulic assembly. The hydraulic assembly has at least one hydraulic tank connected to one hydraulic pump. Separating the delivery and return of the hydraulic fluid in the cylinders permits a simpler design of the hydraulic system and a more flexible choice of valves to be used, which also leads to cost savings.

According to an embodiment, the at least one delivery valve comprises a proportional valve. Not only does this allow hydraulic fluid to be supplied selectively to the free lift cylinder or the mast lift cylinder, but it also allows hydraulic fluid to be supplied to both cylinders at the same time. Using proportional valves, the volume flow of the hydraulic fluid can be adjusted flexibly and can be distributed to free lift cylinders and mast lift cylinders. Depending on the valve position, the free lift and the mast lift can thus be carried out either independently of each other or simultaneously when a load is lifted. In particular, the delivery valve can comprise a 3/2-way proportional valve. This valve allows for a flexible supply of hydraulic fluid to the free lift cylinder or to the mast lift cylinder or to both valves simultaneously while also having a simple design. According to another embodiment, the at least one recirculation valve can also comprise a proportional valve. In this way, the volume flow of the hydraulic fluid that is fed back from the cylinders into the hydraulic assembly can be flexibly adjusted using the at least one recirculation valve. Accordingly, the free lift and/or the mast lift can be flexibly controlled during a lowering process. Also during the lowering of the load, the free lift and the mast lift can be carried out independently of each other or simultaneously, depending on the valve position. This can be accomplished in an especially simple way by means of a 2/2-way proportional valve.

According to a further embodiment, the delivery valve connects a supply line to the free lift cylinder via a first connecting line and/or to the at least one mast lift cylinder via a second connecting line. The supply line is thereby connected to the hydraulic assembly. Said delivery valve can divide the hydraulic fluid that is conducted from the hydraulic assembly via the shaped supply line into the first connecting line and the second connecting line and can then supply the free lift cylinder and the mast lift cylinder with hydraulic fluid. Depending on the valve position, however, it is also possible to supply only the free lift cylinder or only the mast lift cylinder with hydraulic fluid. This simplifies the design of the device. In particular, the delivery valve in this case can be a 3/2-way proportional valve. This permits the especially simple and efficient control of the free lift cylinder and the mast lift cylinder. A valve such as this is cost-effective as well.

According to another embodiment, the at least one recirculation valve connects a first return line, which branches off from the first connecting line, and/or a second return line, which branches off from the second connecting line, to the hydraulic assembly independently of the delivery valve. According to this embodiment, there can be two return lines, which serve to recirculate hydraulic fluid from the cylinders. The first return line branches off from the first connecting line and is thus connected to the free lift cylinder by the first connecting line. The second return line branches off from the second connecting line and is thus connected to the mast lift cylinder by the second connecting line. Free lift cylinders and mast lift cylinders can be retracted separately from each other via the separate return lines, and the free lift and mast lift can thus be carried out separately. At least two recirculation valves can be provided, wherein the first return line can have a first recirculation valve and the second return line can have a section recirculation valve. This permits an especially simple and cost-effective use of 2/2-way proportional valves as the first and second recirculation valves for recirculating the hydraulic fluid from the cylinders back into the hydraulic assembly.

According to a further embodiment, the first return line and the second return line can be merged into a common third return line. In particular, the first return line and the second return line can be merged into a common third return line via the at least one recirculation valve. This further simplifies the design. According to a further embodiment, the at least one recirculation valve can be a recycling 3/2-way proportional valve, by which the first return line and the second return line are merged into a common third return line. Via the 3/2-way proportional valve, either the hydraulic fluid can be recycled into the hydraulic assembly from the free lift cylinder or the at least one mast lift cylinder or it can be recycled from both cylinders at the same time. It is then possible to continue using a 4/2-way proportional valve, which selectively separates the first return line and the second return line from the recycling 3/2-way proportional valve or connects them to the recycling 3/2-way proportional valve. The use of the 4/2-way proportional valve can thus prevent hydraulic fluid from flowing back into the hydraulic assembly if lowering the hydraulic cylinder is not desired. If the cylinders should be lowered, then the 4/2-way proportional valve is first switched to its flow-through position so that the hydraulic fluid can reach the 3/2-way proportional valve. Alternatively, two, 2/2-way proportional valves may be used as recirculation valves.

According to a further embodiment, the first connecting line has a check valve between the delivery valve and the branch connection of the first return line from the first connecting line. The connecting line can also have a check valve between the delivery valve and the branch connection of the second return line from the second connecting line. In particular, both the first and the second connecting lines can have a check valve such as this. The check valve ensures that no hydraulic fluid can flow back from the cylinders through the delivery valve. Instead, only the path through the first and/or second return line, and thus through the at least one recirculation valve, remains available to the hydraulic fluid that is flowing back flowing back.

According to another embodiment, the hydraulic assembly comprises a hydraulic pump and a hydraulic tank, wherein said hydraulic pump conducts hydraulic fluid out of the hydraulic tank through the supply line and via the delivery valve to the free lift cylinder and/or the mast lift cylinder. A desired lifting speed of the load can be achieved using the hydraulic pump by carrying out the free lift and/or the mast lift at the corresponding speed. In particular, the pump speed of the hydraulic pump can be controlled for this purpose. The lifting speed can also be controlled by an appropriate valve position of the delivery valve, which distributes the hydraulic fluid supplied by the hydraulic pump to the free lift cylinder and the at least one mast lift cylinder.

According to a further embodiment, the supply line has an isolation valve to separate the hydraulic flow from the hydraulic assembly to the delivery valve. The hydraulic flow can also at least be choked by the isolation valve. Furthermore, a functional line branching off from the supply line can be provided to supply further hydraulic elements with hydraulic fluid. In this way, the hydraulic flow to the lift cylinders can be interrupted or choked by the isolation valve in order to make a sufficient amount of hydraulic fluid available to further hydraulic elements. The isolation valve can, for example, be configured as a proportional valve or as a switching valve.

According to an embodiment, a control unit is configured to actuate the at least one delivery valve and/or the at least one recirculation valve. In particular, the control unit can actuate the delivery valve and/or the at least one recirculation valve electrically. The delivery valve and the at least one recirculation valve can then be electrically actuatable valves.

Moreover, the free lift cylinder or the at least one mast lift cylinder can have a sensor that is configured to communicate with the control unit to determine the lifting height of the load carrier. In particular, both the free lift cylinder and the at least one mast lift cylinder can each have a lifting height sensor. The lifting height sensor can especially be a position sensor that measures the position of a piston rod of the free lift cylinder or the mast lift cylinder. The farther the piston rod is extended from the respective cylinder, the farther the free lift and or mast lift has been carried out and the higher the lifting height of the load carrier. The lifting height of a load transported on the load carrier can be determined from the lifting height of the load carrier. According to a further embodiment, the free lift cylinder and/or the mast lift cylinder has a sensor configured to communicate with the control unit to determine the lifting speed and/or lowering speed of the load carrier. The sensor in this case can be the same sensor that determines the lifting height. In particular, both the free lift cylinder and the at least one mast lift cylinder can each have a speed sensor. The speed sensor can measure the movement speed of a piston rod of the free lift cylinder and/or mast lift cylinder. Based on the movement speed of the piston rods, a conclusion can be drawn about the lifting speed of the load carrier being moved by the piston rods of the two cylinders.

Preferably, the control unit is then configured to activate the delivery valve and/or the recirculation valve as a function of the lifting height of the load carrier determined by the sensor in order to control the lifting speed and/or lowering speed of the load carrier. The lifting height sensor of the free lift cylinder and/or mast lift cylinder measures, for example, a current position of the piston rod of the respective cylinder. The measured values that are recorded are transmitted to the control unit, which then controls the lifting or lowering speed of the respective valve. The lifting and lowering speed of the load carrier is thus controlled as a function of the lifting height of the load carrier. In this way, particular ranges of the lifting height can be defined, within which different lifting or lowering speeds should be applied. For instance, the lifting speed or the lowering speed of the load carrier can be reduced near the end range of the free lift cylinder or mast lift cylinder (i.e., shortly before the respective piston rod of the respective cylinder has been fully extended or retracted). This ensures that the piston rod makes gentle contact with the cylinder housing and thereby, inter alia, a softer transition between the free lift and the mast lift.

The control unit may be configured to activate the delivery valve to adjust a target lifting speed and/or the recirculation valve to set a target lowering speed of the load carrier and to calculate a control deviation between the target lifting speed and the actual lifting speed detected by the sensor and/or between the target lowering speed and the actual lowering speed detected by the sensor. Based on this control deviation, the control unit may be configured to activate the delivery valve and/or the recirculation valve to control the supply of hydraulic fluid to the free lift cylinder and/or mast lift cylinder. In this embodiment, a target lifting speed for the load carrier and thus for the load is prescribed by the control unit by means of a particular position of the delivery valve. Accordingly, the recirculation valve can be activated via the control unit such that a defined target lowering speed of the load carrier and thus the load are set. However, these target speeds are subject to a multitude of external disturbances, such as different loads, fluctuating oil viscosity, pump efficiency, or mechanical losses in the system. The target speed can therefore deviate from the actual speed ultimately achieved. To compensate for a deviation such as this, the actual lifting speed and/or the actual lowering speed of the load carrier are first ascertained by the aforementioned sensors on the free lift cylinder and/or on the at least one mast lift cylinder. This can occur, for example, by measuring the movement speed of the piston rod of the respective hydraulic cylinder relative to the respective cylinder housing. The control unit is configured to determine the deviation between the actual speeds and the target speeds of the piston rods of the respective cylinders, and the position of the delivery valve and/or the at least one recirculation valve is appropriately readjusted. By using this feedback, a predetermined lifting of lowering speed of the load carrier and thus of the load can be maintained in a significantly more precise and reliable way.

BRIEF DESCRIPTION OF THE DRAWINGS

The invention is explained in below according to the drawings. The following is shown.

DETAILED DESCRIPTION OF THE INVENTION

Figure 1:
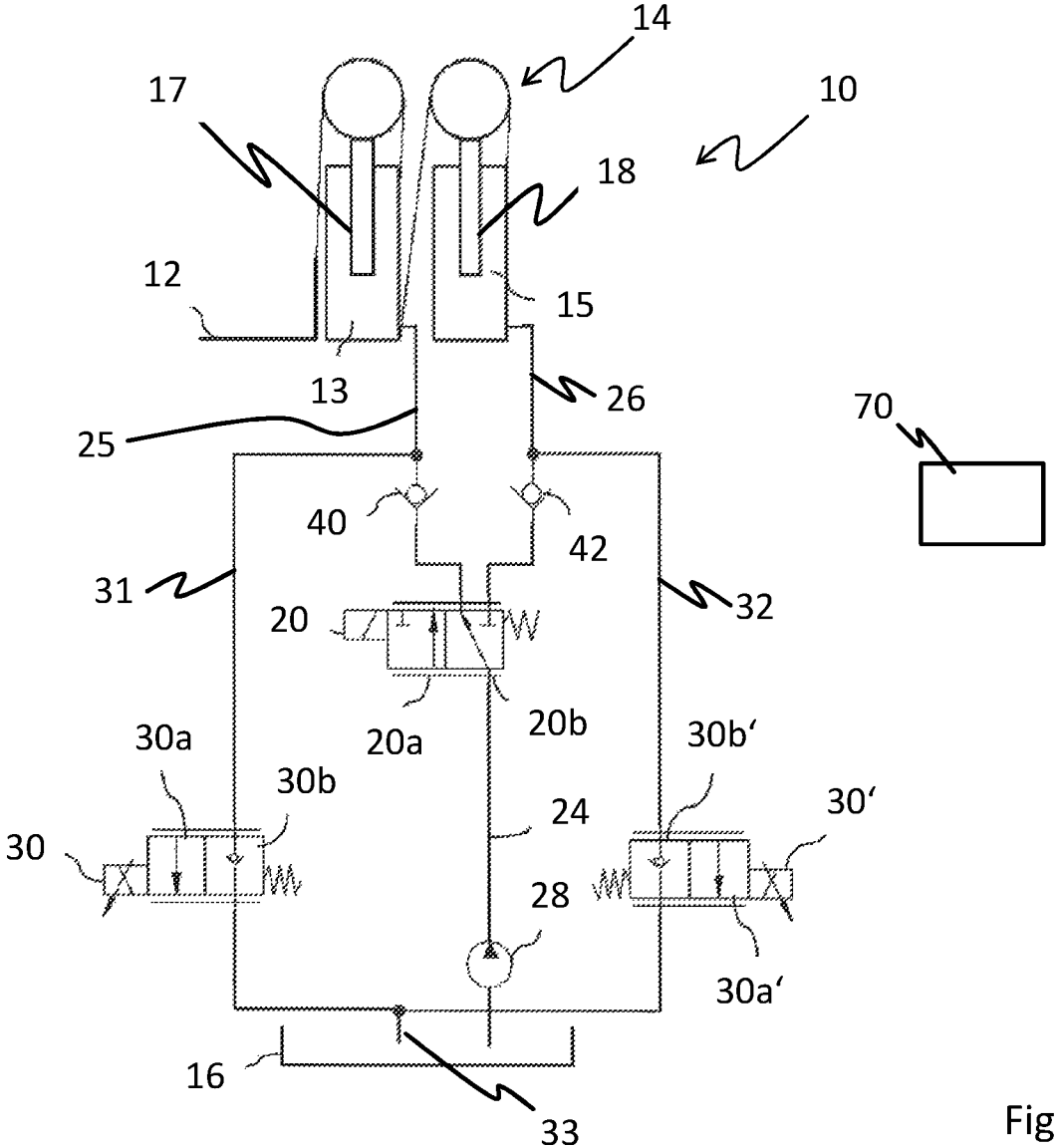
FIG. 1 illustrates an embodiment of a lifting device.

FIG. 1 shows an embodiment of the lifting device. The lifting device has a schematically represented lift frame 10 with a load carrier 12 and a mast stage 14 that are both moveably guided. As shown, the load carrier 12 comprises a lift fork. The free lift cylinder 13 is configured to actuate the load carrier 12 while the mast lift cylinder 15 is configured to actuate the mast stage 14. The load carrier 12 can be raised and/or lowered in free lift mode by activating the free lift cylinder 13, and the load carrier 12 can be raised and/or lowered in mast lift mode by activating the mast lift cylinder 15. When the mast lift cylinder 15 is actuated, the load carrier 12 is moved together with the free lift cylinder 13. The free lift cylinder 13 comprises a schematically represented piston rod, wherein a sensor 17 is arranged on the piston rod or in the vicinity of the piston rod. The mast lift cylinder 15 also has a corresponding piston rod, on or near which a sensor 18 is arranged.

A hydraulic tank 16 and a hydraulic pump 28 together form a hydraulic assembly.

The hydraulic tank 16 provides hydraulic fluid to supply the free lift cylinder 13 and the mast lift cylinder 15 by means of the hydraulic pump 28. A delivery valve 20 connects the hydraulic tank 16 to the free lift cylinder 13 and to the mast lift cylinder 15. Said delivery valve 20 is a 3/2-way proportional valve having three (3) line connectors and two (2) valve positions. The hydraulic tank 16 is connected to a connector of the delivery valve 20 via a supply line 24, while the free lift cylinder 13 is connected via a first connecting line 25 and the mast lift cylinder 15 is connected via a second connecting line 26 to the rest of the connectors in the delivery valve 20. The two possible valve positions of the delivery valve 20 are identified with reference signs 20*a* and 20*b*, wherein valve position 20*a* connects the supply line 24 to connecting line 26 and thus to the mast lift cylinder 15, while valve position 20*b* connects the supply line 24 to first connecting line 25 and then on to the free lift cylinder 13. Since the delivery valve 20 is a proportional valve, any desired intermediate positions are possible between valve positions 20*a* and 20*b*, and so the supply line 24 can also be connected to first and second connecting lines 25 and 26 at the same time. The delivery valve 20 is electrically actuated by a control unit or control device 70. A first and a second check valve 40, 42 are provided in the first and second connecting lines 25, 26, respectively, and they prevent the back-flow of hydraulic fluid from the cylinders 13, 15 to the delivery valve 20.

Furthermore, two recirculation valves 30, 30' can be seen in FIG. 1, wherein the first recirculation valve 30 is connected via a first return line 31 to the free lift cylinder 13 and to the hydraulic tank 16, while the second recirculation valve 30' is connected via a second return line 32 to the mast lift cylinder 15 and to the hydraulic tank 16. The first return line 31 and the second return line 32 are merged by a common third return line 33. The first return line 31 branches off from the first connecting line 25 upstream of check valve 40, while the second return line 32 branches off from the second connecting line 26 upstream of check valve 42. The two recirculation valves 30, 30' are 2/2-way proportional valves that have two connectors and two valve positions. In a first valve position 30*a*, the first recirculation valve 30 permits the back-flow of hydraulic fluid out of the free lift cylinder 13 into the hydraulic tank 16. In a second valve position 30*b*, the first recirculation valve 30 blocks the back-flow of hydraulic fluid out of the free lift cylinder 13. The second delivery valve 30' is designed similarly and thus has a flow-through position 30*a*' and a blocked position 30*b*'. Since the recirculation valves 30, 30' are proportional valves, any desired intermediate positions are also possible here. In this way, it is possible to control the volume flow of the back-flow from the free lift cylinder 13 or the mast lift cylinder 15 by means of the valve position. The recirculation valves 30, 30' are also electrically actuated by means of the control device 70.

Figure 2:
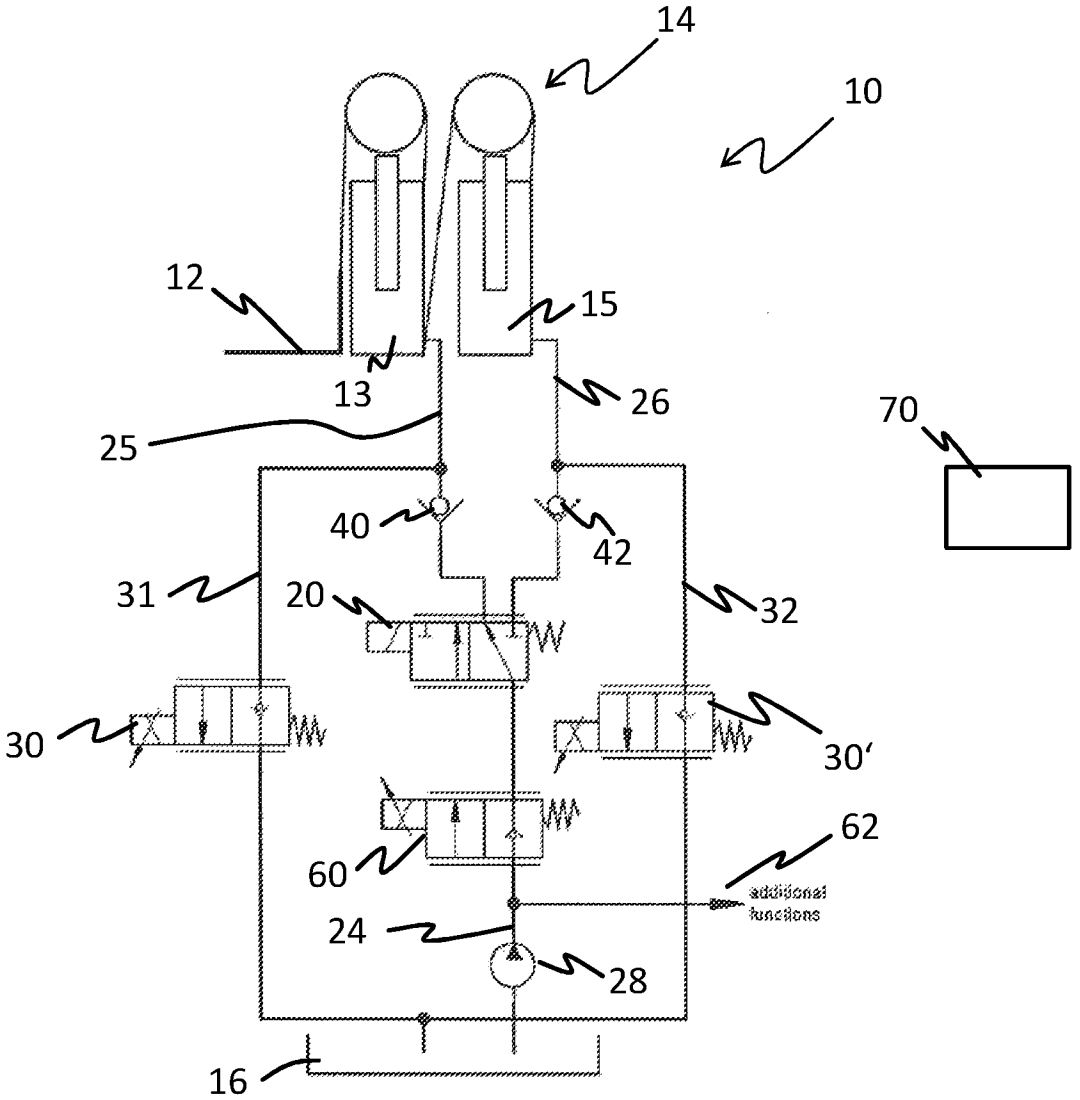
FIG. 2 illustrates another embodiment of the lifting device.

The embodiment of lifting device shown in FIG. 2 further comprises isolation valve 60, which can control and interrupt the hydraulic flow from the hydraulic tank 16 to the delivery valve 20. The isolation valve 60 may be a 2/2-way proportional valve with a flow-through position and a blocked position. However, the isolation valve 60 can also be configured as a switching valve. When the isolation valve 60 is a proportional valve it can also assume any desired intermediate positions to control the flow of hydraulic fluid. The isolation valve 60 can choke or interrupt the supply of hydraulic fluid to the free lift cylinder 13 and/or the mast lift cylinder 15 in order to make a part of the volume flow of the hydraulic fluid available for further functions of the industrial truck via a branch line 62.

Figure 3:
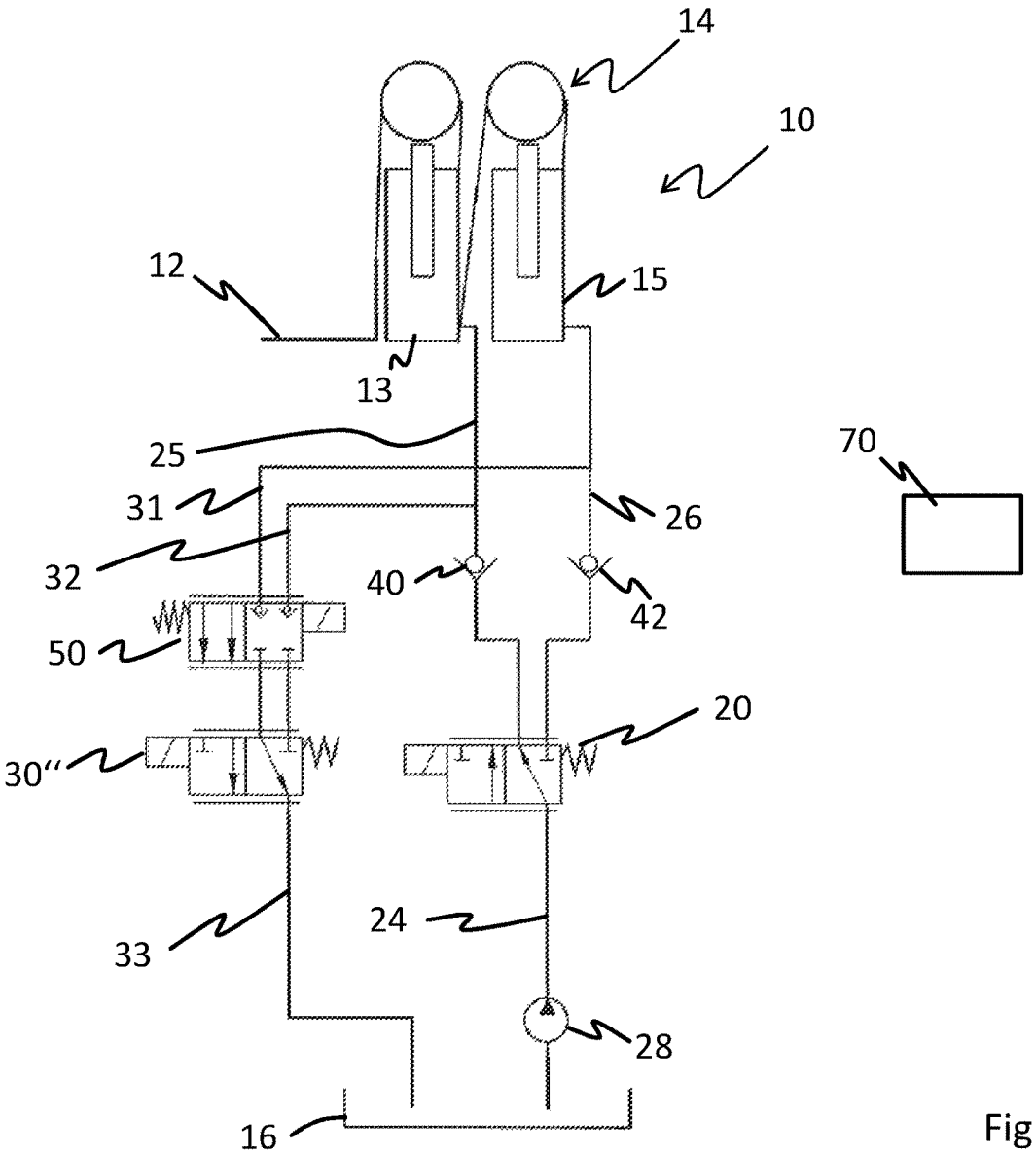
FIG. 3 illustrates an embodiment of the lifting device.

FIG. 3 shows a further embodiment of the lifting device. This embodiment differs from the embodiment shown in FIG. 1 by the use of valves other than recirculation valves. The branching to supply the hydraulic fluid to the cylinders is the same as in FIG. 1. In the embodiment in FIG. 3, a 3/2-way proportional valve is provided as the first circulation valve 30, by which the first return line 31 and the second return line 32 are merged into a common third return line 33. Additionally, a 4/2-way proportional valve 50 is provided as a recirculation valve, by which the first return line 31 and the second return line 32 can be separated from the 3/2-way proportional valve 30' or connected to it.

Figure 4:
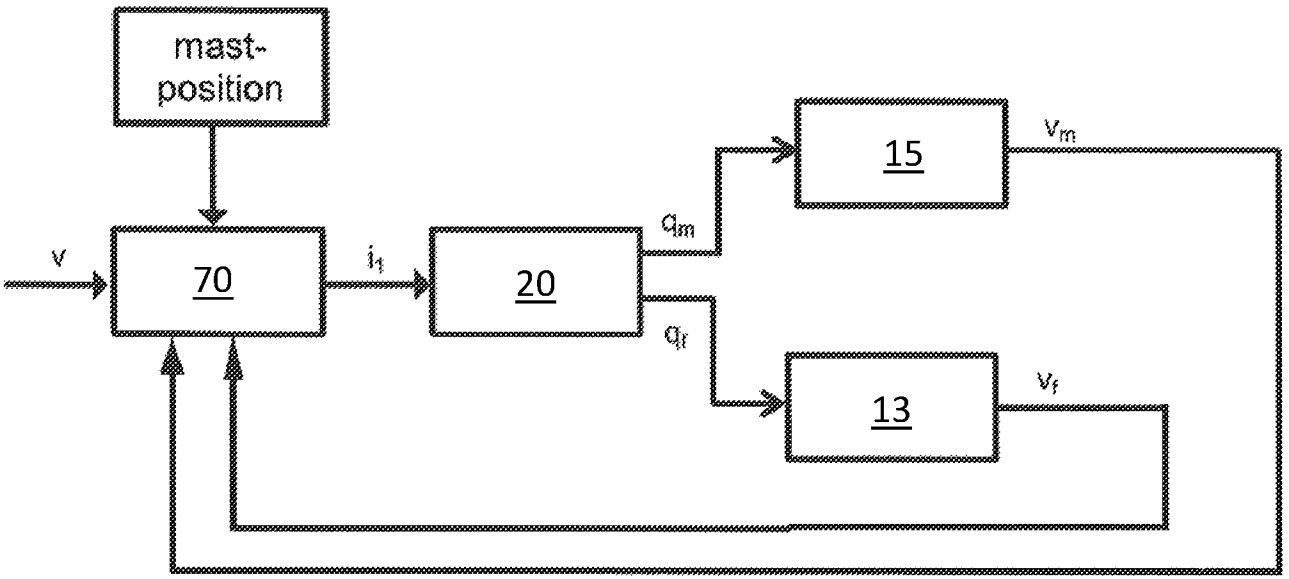
FIG. 4 illustrates an embodiment of a control flow diagram for the control of the lifting speed.
Figure 5:
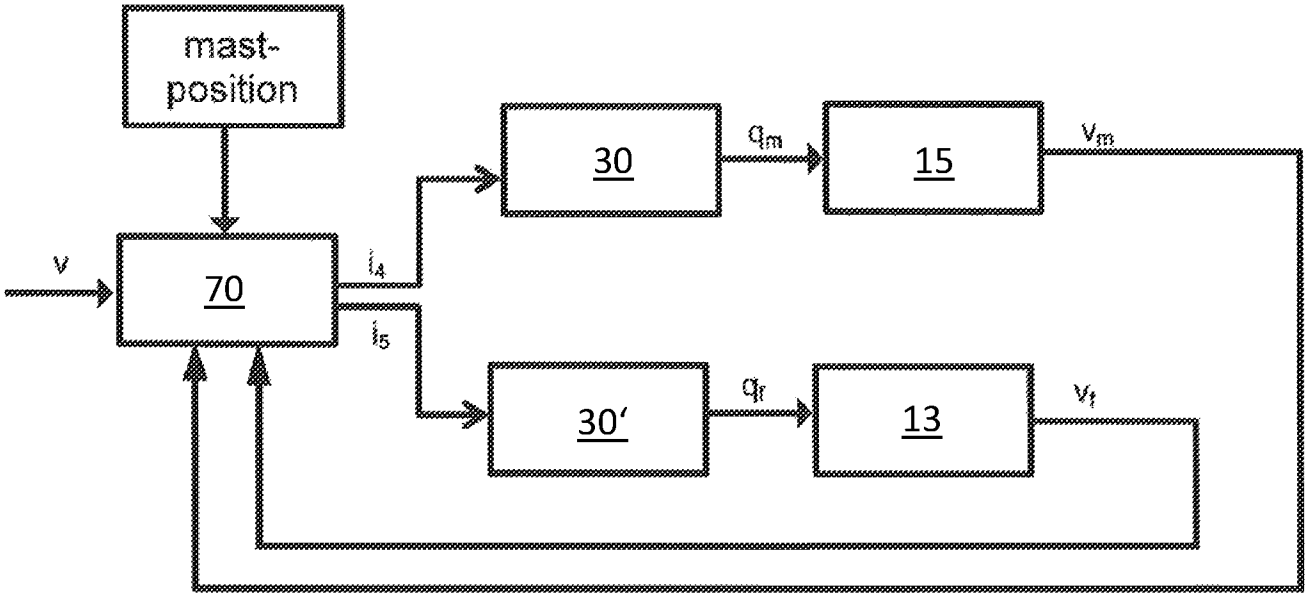
FIG. 5 illustrates an embodiment of a control flow diagram for the control of the lowering speed.

Referring to FIGS. 4 and 5, in order to lift the load carrier 12 (FIGS. 1-3, 6-11), hydraulic fluid is conducted out of the hydraulic tank 16 (FIGS. 1-3, 6-11) by the hydraulic pump 28 (FIGS. 1-3, 6-9) through the supply line 24 (FIGS. 1-3, 6-11) and the delivery valve 20 (FIGS. 1-3) in valve position 20*b* (FIG. 1) as well as through the first connecting line 25 (FIGS. 1-3, 6-11) and into the free lift cylinder 13. The free lift is carried out in this way. The position of the piston rod of the free lift cylinder 13 in this case is monitored by a position sensor and is transmitted to the control unit 70. The mast position is monitored in this way. Shortly before the free lift cylinder 13 reaches its end position, the delivery valve 20 (FIGS. 1-4) is gradually switched into valve position 20*a* (FIG. 1) by the control unit 70. Thus the volume flow to the free lift cylinder 13 is reduced and the volume flow to the mast lift cylinder 15 is initiated. In this way, the piston rod of the free lift cylinder 13 makes contact slowly and gently. Hydraulic fluid is now conducted out of the hydraulic tank 16 (FIGS. 1-3, 6-11) by means of the hydraulic pump 28 (FIGS. 1-3, 6-9) via the supply line 24 (FIGS. 1-3, 6-11) through the delivery valve 20 (FIGS. 1-4) and into the second connecting line 26 (FIGS. 1-3, 6-11) and thus into the mast lift cylinder 15. This results in the extension of the piston rod of the mast lift cylinder 15 and thus to the start of the mast lift. In mast lift mode, the load carrier 12 (FIGS. 1-3, 6-11) is raised along with the free lift cylinder 13. By appropriately positioning the delivery valve 20 (FIGS. 1-4), however, it is likewise possible to carry out the mast lift first and then the free lift. It is also possible to carry out both at the same time.

Using the delivery valve 20 (FIGS. 1-4), the target speed provided by the control unit 70 for the movement of the load carrier 12 (and thus the load) can be translated into a volume flow of the hydraulic fluid to the free lift cylinder and/or mast lift cylinder. As depicted in FIG. 4, the person operating a control unit 70 can enter a preset speed $v$, for example. In accordance with this preset target speed $v$, the control unit 70 controls the valve position of the delivery valve 20 by means of a control current i1. The delivery valve 20 then divides the volume flow of hydraulic fluid coming from the hydraulic pump 28 (FIGS. 1-3, 6-9) into two (2) volume flows $q_m$ and $q_f$, wherein volume flow $q_m$ moves the mast lift cylinder 15 and volume flow $q_f$ moves the free lift cylinder 13. The desired target lifting speed $v$ is controlled by the pump speed of the hydraulic pump 28 (FIGS. 1-3, 6-9), while the delivery valve 20 distributed the hydraulic fluid to the two cylinders 13, 15. The sensors 17, 18 provided on the free lift cylinder 13 and/or the mast lift cylinder 15 additionally detect the actual lifting speed $v_f$ of the load carrier and/or the actual lifting speed $v_m$ of the mast stage 14. This can be carried out, for example, by measuring the movement speed of the piston rod of the respective valve relative to the respective piston housing. The actual speeds $v_f$, $v_m$ can deviate from the preset target speed $v=v_f+v_m$ as a result of disturbances, such as different loads, oil viscosities or pump efficiency as well as mechanical losses. For this reason, the control unit 70 calculates this deviation of the actual speed $v_f$ of the free lift and the actual speed $v_m$ of the mast lift into the control variable ν and adapts the valve stream $i_1$ and thus the valve position of the delivery valve 20. Therefore, the actual speeds are continuously corrected to the target speed. This leads to a significantly more precise control of the movement of the load.

To lower a load located on the load carrier 12 (FIGS. 1-3, 6-11), hydraulic fluid can be conducted via the recirculation valves 30, 30' from the free lift cylinder 13, from the mast lift cylinder 15 or from both back to the hydraulic tank 16 (FIGS. 1-3, 6-11). For lowering in free lift mode, only the first recirculation valve 30 (FIGS. 1, 2, 5-11) is actuated; in other words, it is switched to valve position 30*a* (FIGS. 1, 6-9). For lowering in mast lift mode, only recirculation valve 30' (FIGS. 1, 6-9) is actuated; in other words, it is switched to valve position 30*a*' (FIGS. 1, 6-9). Hydraulic fluid streaming out of the free lift cylinder 13 flows via the first connecting line 25 (FIGS. 1-3, 6-11) through the branch connection into the first return line 31 (FIGS. 1-3, 6-11) and via the first recirculation valve 30 (FIGS. 1,2, 5-11) into the hydraulic tank 16. Hydraulic fluid streaming out of the mast lift cylinder 15 flows via the connecting line 26 (FIGS. 1-3, 6-11) through the branch connection via the second return line 32 (FIGS. 1-3, 6-11) through the second recirculation valve 30' into the hydraulic tank 16. As can be seen in FIG. 5, the control unit 70 provides a preset lowering speed ν as the electrical control currents i4, i5 to the two recirculation valves 30, 30'. The valve position of the first recirculation valve 30 is controlled by the electric control current i4, and so a volume flow of hydraulic fluid $q_m$ reaches the mast lift cylinder 15. Accordingly, the valve position of the second recirculation valve 30' is controlled by the electric control current i5, and so a volume flow $q_v$ of hydraulic fluid reaches the free lift cylinder 13. The actual lowering speeds $v_f$ of the free lift and $v_m$ of the mast lift are calculated by the sensors 17, 18 (FIGS. 1, 6-11) and transmitted to the control unit 70. The control unit 70 calculates the control deviation of the actual lowering speeds $v_f$, $v_m$ into control variable ν and computes from it the necessary adaptation of the electrical control currents i4, i5. As with the lifting process, disturbances can also be eliminated and the control of the lowering process is performed with greater precision.

Moreover, the lifting height (i.e. the mast position of the load carrier 12 (FIGS. 1-3, 6-11)) is used during the lowing process, as well, to control the lowering speed in particular ranges. As with the lifting process, this makes it possible to reduce the lowering speed in the end ranges of the free lift cylinder 13 and/or the mast lift cylinder 15 so that dampened contact is achieved during lowering. The electrical currents i4, i5 are calculated using the control loop depicted in FIG. 5 such that the lowering speed of the load also remains constant in the transitional range between the mast lift and the free lift. During both the lifting process and the lowering process, the free lift cylinder travels at a speed where $v_f < v_m$ in its lift stop. This results in a very gentle transition between free lift and mast lift. The lifting height of the load carrier and/or of the mast stage is entered into the control unit 70 as the mast position, as is shown in FIGS. 4 and 5. A corresponding control can also occur for the mast lift cylinder 15. If, for instance, a lowing process is initiated from the mast lift, then the second recirculation valve 30' is moved toward valve position 30*a*' (FIGS. 1, 6-9) until the desired lowering speed is achieved. Shortly before the mast lift cylinder 15 is fully retracted, the volume flow of the mast lift cylinder 15 is gradually reduced in that the second recirculation valve 30' is gradually moved into the blocked position 30*b*' (FIGS. 1, 6-9). While the recirculation valve 30' is being closed, the first recirculation valve 30 is opened, i.e. it is moved into valve position 30*a* (FIGS. 1, 6-9), and the lowering process is thereby ensured by the free lift. As was mentioned above, the two recirculation valves 30, 30' are controlled in such a way that the lowering speed remains constant despite the changing valve positions.

However, it is also entirely possible to achieve the aforementioned functions of the lifting device according to the description without a 3/2-way proportional valve. Referring to the embodiment shown in FIG. 6, a 2/2-way proportional delivery valve 100 is arranged in the first connecting line 25 leading to the free lift cylinder 13 and is configured to act as the delivery valve instead of the 3/2-way proportional valve. The 2/2-way proportional delivery valve 100 has a blocked position 100*a* and a flow-through position 100*b*, wherein the 2/2-way proportional delivery valve 100 can also assume any desired intermediate positions. The supply line 24 splits into the first and second connecting lines 25,26 upstream of the hydraulic pump, wherein connecting line 26 does not have a delivery valve. Required here is that the pressure $p_1$ necessary to actuate the free lift cylinder 13 is always lower than the pressure $p_2$ necessary to actuate the mast lift cylinder 15. Thus $p_1 < p_2$ must be true. This can be achieved in particular by selecting the effective piston surface of the free lift cylinder 13 to be larger than the effective piston surface of the mast lift cylinder 15.

To lift the load carrier 12, hydraulic fluid is conducted out of the hydraulic tank 16 by the hydraulic pump 28 through the supply line 24 and the 2/2-way proportional delivery valve 100 in valve position 100*b* as well as through the first connecting line 25 and into the free lift cylinder 13. Moreover, hydraulic fluid is also conducted through connecting line 26 to the mast lift cylinder 15. As long as the prevailing system pressure p is lower than the pressure $p_2$ required to actuate the mast lift cylinder 15 (i.e., as long as $p < p_2$) initially only the free lift cylinder 13 is moved and thus the free lift is carried out. When the free lift cylinder 13 reaches its lift stop, the system pressure p rises until $p_2$ is reached. Then the mast lift begins with the actuation of the mast lift cylinder 15. Thus the free lift is carried out first and subsequently the mast lift.

The lifting sequence and the lifting speed of the mast stage and load carrier 12 in this embodiment can also be controlled in accordance with the control method explained above. So the position of the piston rod of the free lift cylinder 13 can be monitored by a position sensor and transmitted to the control unit 70. Shortly before the free lift cylinder 13 reaches its end position, the delivery valve 2/2-way proportional 100 is gradually switched into blocked valve position 100*a* by the control unit 70. The volume flow to the free lift cylinder 13 is thus reduced. In this way, the piston rod of the free lift cylinder 13 makes contact gently at a lower speed. At the same time, the system pressure p in the supply line 24 and in the connecting line 26 increases, which leads to an actuation of the mast lift cylinder 15 as soon as $p \geq p_2$. Thus the volume flow coming from the hydraulic pump 28 is gradually conducted to the mast lift cylinder 15. In particular, the lifting movement of the load carrier 12 remains at least approximately constant even during this rerouting process between the valve positions. At the end of the rerouting process, the 2/2-way proportional delivery valve 100 is entirely in its blocked position 100*a* and the free lift cylinder 13 is fully extended.

The control of the lifting sequence and lifting speed can take place in accordance with the control method explained above. For instance, using the delivery valve 100, the target speed provided by the control unit 70 for the movement of the load carrier 12 can be translated into a volume flow of the hydraulic fluid to the free lift cylinder and/or mast lift cylinder. As depicted in FIG. 4, the person operating a control unit 70 can enter a preset speed v, for example. In accordance with this preset target speed v, the control unit 70 controls the valve position of the 2/2-way proportional delivery valve 100 by means of a control current i1. In this embodiment, as well, the 2/2-way proportional delivery valve 100 divides the volume flow of hydraulic fluid coming from the hydraulic pump 28 (FIGS. 1-3, 6-9) into the two volume flows $q_m$ and $q_f$. Although a volume flow $q_m$ is always flowing to the mast lift cylinder 15, the volume flow $q_m$ does not have an effect as long as the pressure generated by this volume flow in the mast lift cylinder 15 does not meet the condition $p \geq p_2$. Accordingly, the lifting sequence and lifting speeds of the cylinders 13, 15 is controlled here by the 2/2-way proportional delivery valve 100 and by the different area ratios of the pistons of the free lift cylinder 13 and mast lift cylinder 15. The desired target lifting speed v can also be controlled here by the pump speed of the hydraulic pump 28.

Figure 6:
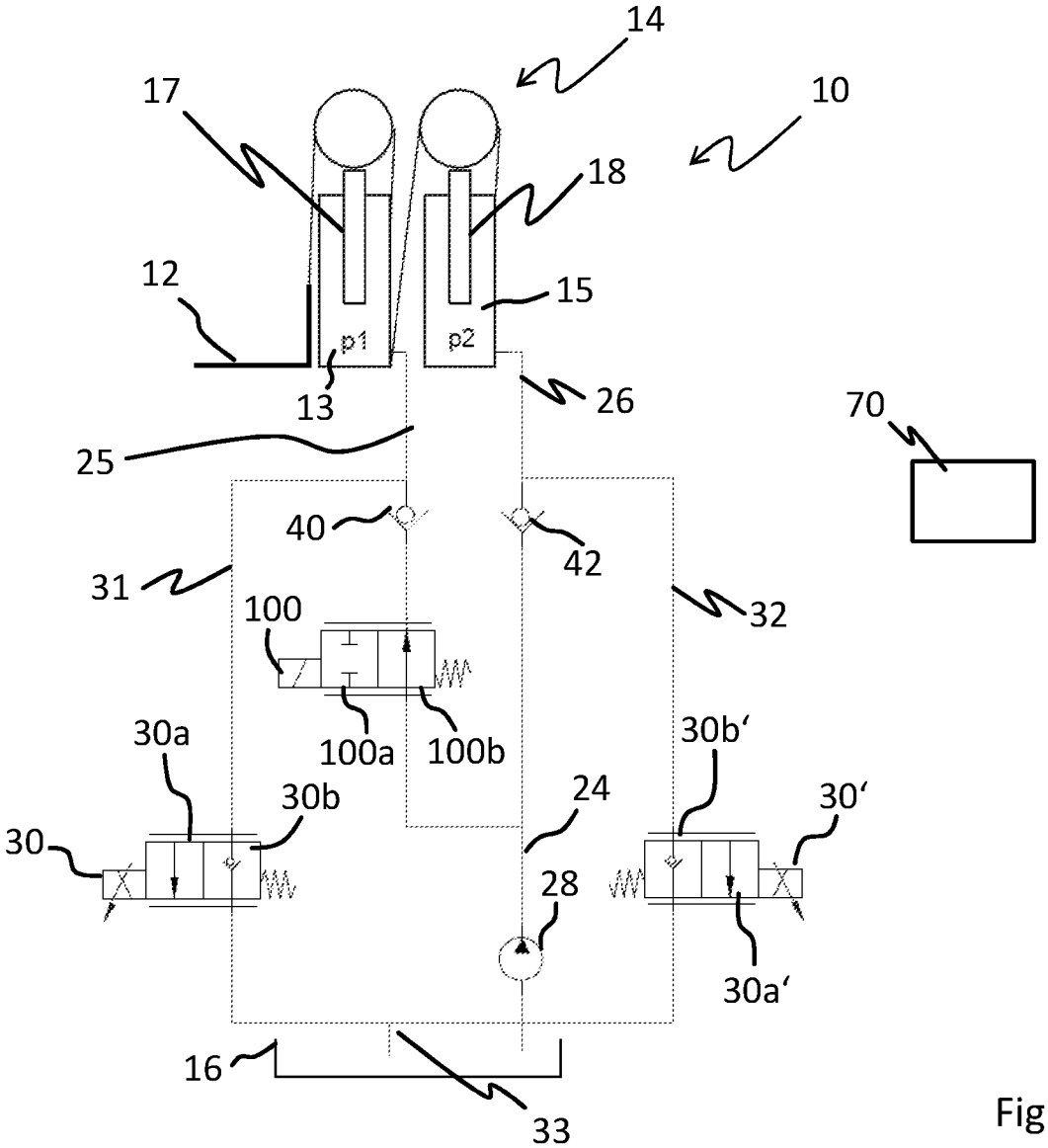
FIG. 6 illustrates another embodiment of the lifting device.

Still referring to FIG. 6 and as was described above, the actual lifting speeds of the cylinders 13, 15 can be controlled by changing the valve position of the 2/2-way proportional delivery valve 100 using the control unit 70. The lowering process takes place via the recirculation valves 30, 30'. In particular, the two recirculation valves can also be activated completely independently of each other here, and the movements of the lifting stages (i.e., load carrier and mast stage) take place completely independently of each other. Additionally, a gentle transition between the lifting stages can be achieved during lowering.

Figure 7:
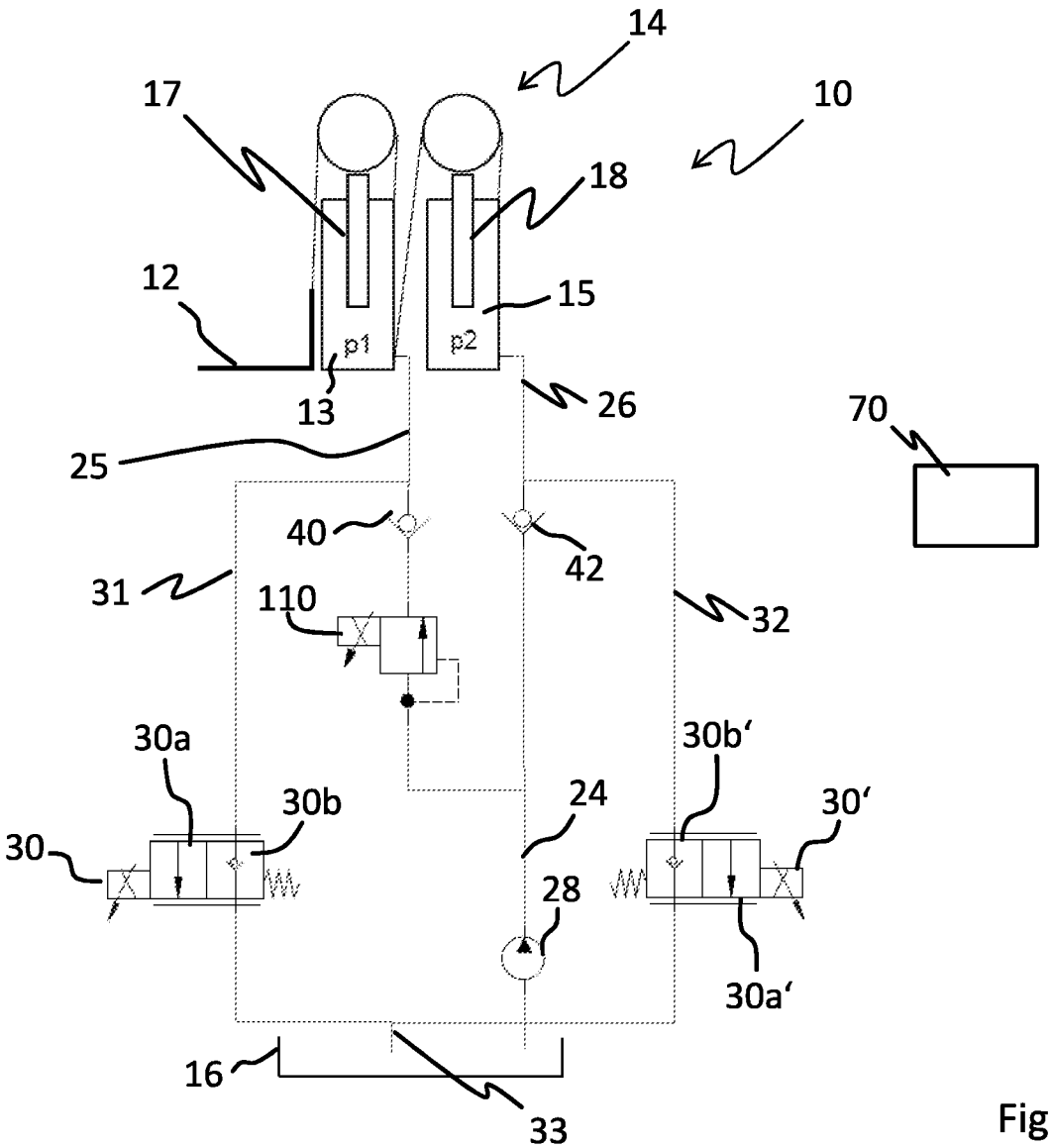
FIG. 7 illustrates another embodiment of the lifting device.

Referring to the embodiment shown in FIG. 7, a proportional pre-charge valve is used as the delivery valve 110 instead of a 2/2-way proportional valve. Similar to the embodiment in FIG. 6, the delivery valve 110 is completely open during the free lift. During the transition from free lift to mast lift, the delivery valve 110 is activated and the pressure in the connecting line 26 that leads to the mast lift cylinder 15 is thereby gradually increased.

Figure 8:
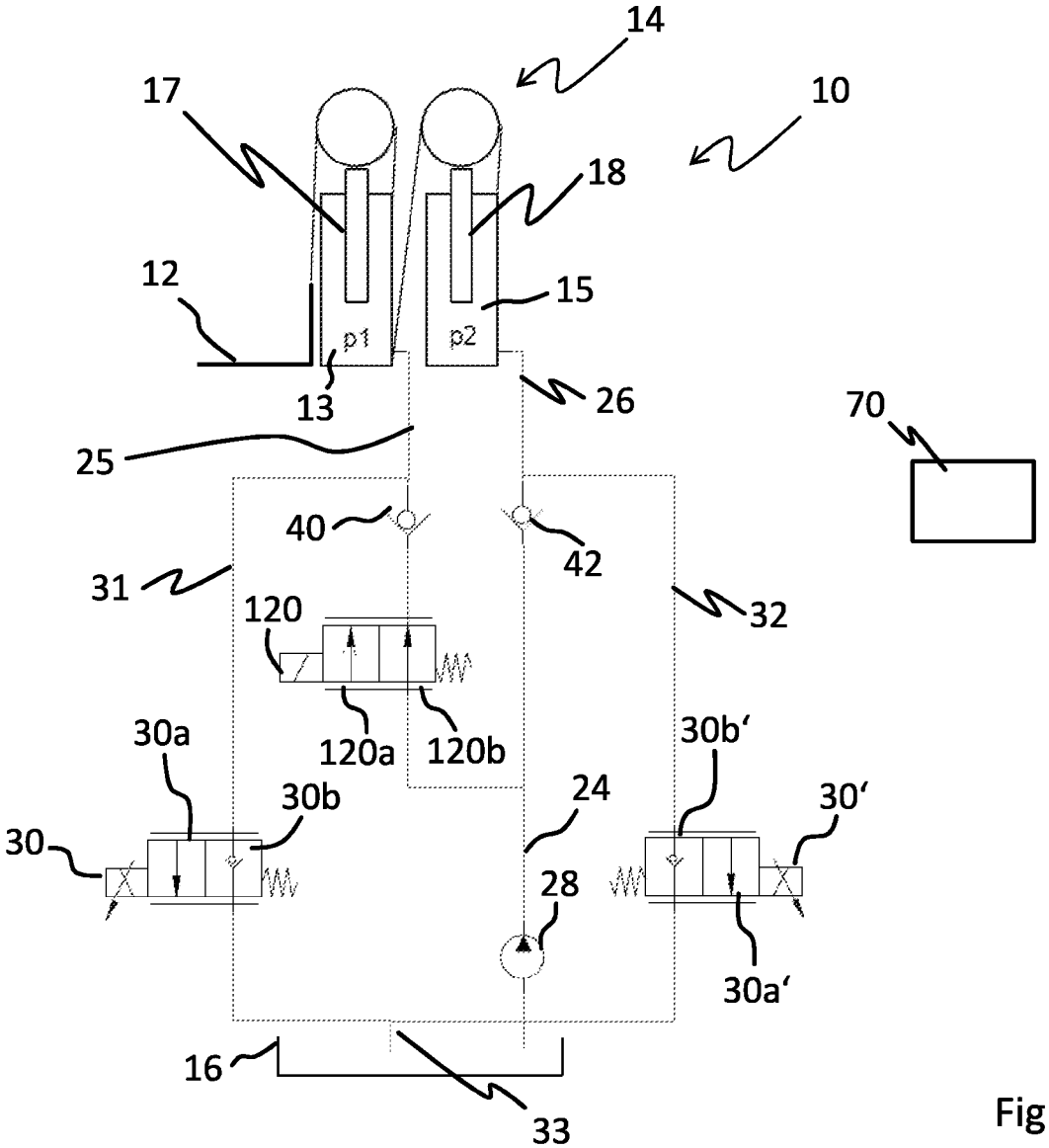
FIG. 8 illustrates another embodiment of the lifting device.

Referring to the embodiment shown in FIG. 8, a proportional pre-charge valve with a choke position 120*a* and a flow-through position 120*b* is used as the delivery valve 120 instead of a 2/2-way proportional valve with a blocked position and a flow-through position. The lifting is carried out essentially as has already been explained with regard to FIG. 6. However, the delivery valve 120 cannot be completely closed, but it instead still permits a flow-through to the free lift cylinder 13 even in the choke position 120*a*. Said cylinder thus moves slowly in it stop without requiring any additional measures, such as the aforementioned position sensor for measuring the piston position. In this way, as well, it is possible to reroute from the free lift to the mast lift in a controlled manner.

Figure 9:
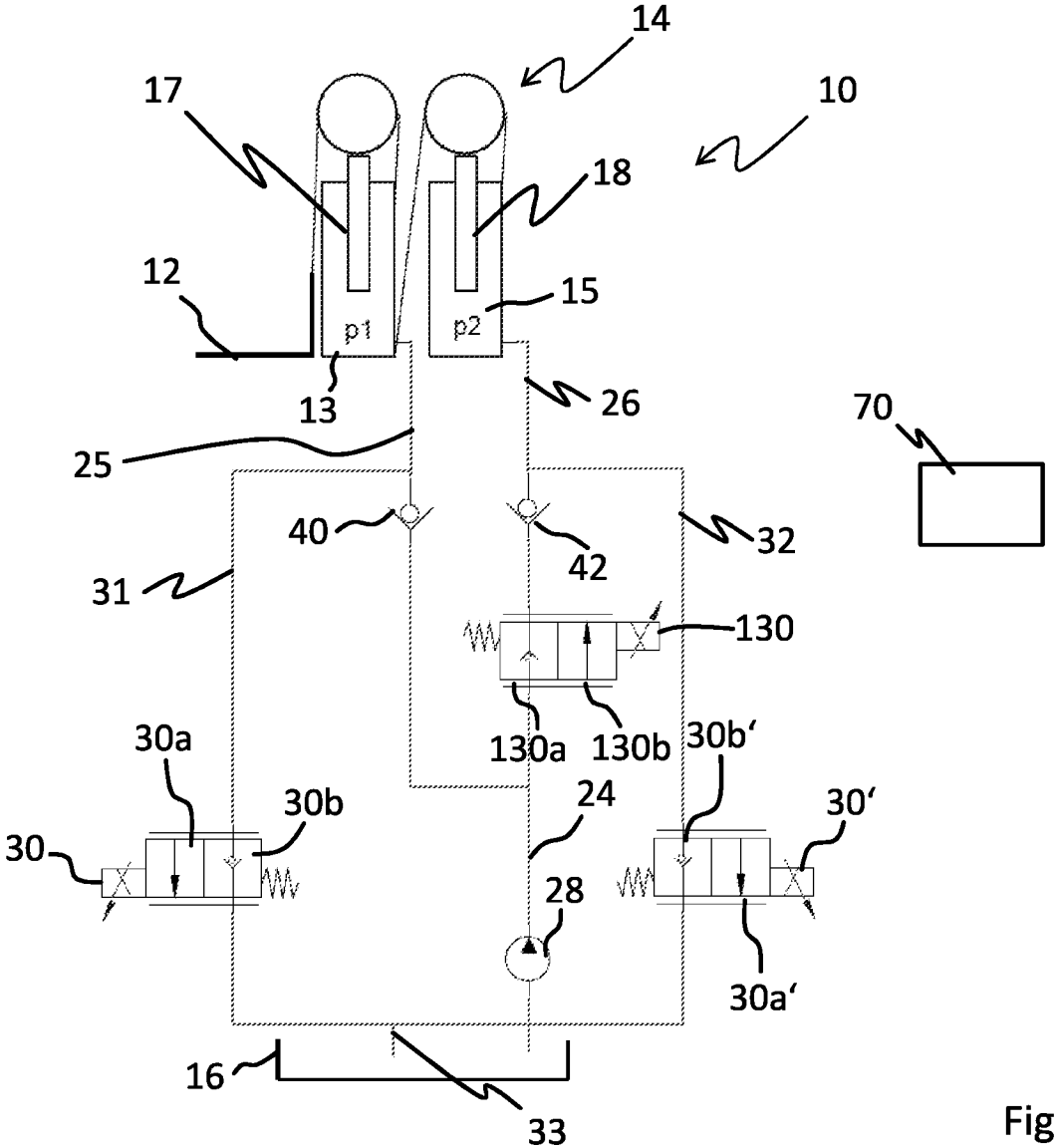
FIG. 9 illustrates another embodiment of the lifting device.

Referring to the embodiment illustrated in FIG. 9, a 2/2-way proportional valve is the delivery valve 130 and is disposed in connecting line 26, which leads to the mast lift cylinder 15, instead of in the first connecting line 25. The 2/2-way proportional delivery valve 130 has a blocked position 130*a*, which acts in the direction of the connecting line 26 and is implemented by a check valve, and a flow-through position 130*b*. However, the same delivery valve as in FIG. 6 could also be provided here. In addition, a requirement of this lifting device is that the pressure $p_1$ necessary to actuate the free lift cylinder 13 is always higher than the pressure $p_2$ necessary to actuate the mast lift cylinder 15. The condition $p_1 > p_2$ must be fulfilled. This can be achieved in particular in that the effective piston surface of the free lift cylinder 13 is smaller than the effective piston surface of the mast lift cylinder 15.

At the beginning of the lifting process, hydraulic fluid is conducted out of the hydraulic tank 16 by the hydraulic pump 28 through the supply line 24 and the first connecting line 25 to the free lift cylinder 13. The delivery valve 130 is in the blocked position 130*a* in this instance. The system pressure p is increased until the pressure $p_1$ required to actuate the free lift is reached. Before the free lift cylinder 13 reaches its end position, the delivery valve 130 is gradually opened, i.e. gradually switched into flow-through valve position 130*b*. As a result, the system pressure p falls to the level of the mast lift cylinder 15. The lifting speed is likewise reduced. Additionally, the volume flow to the mast lift cylinder 15 is released, and so it is actuated. It is therefore possible in this embodiment, as well, that the free lift is carried out first and then the mast lift.

Figure 10:
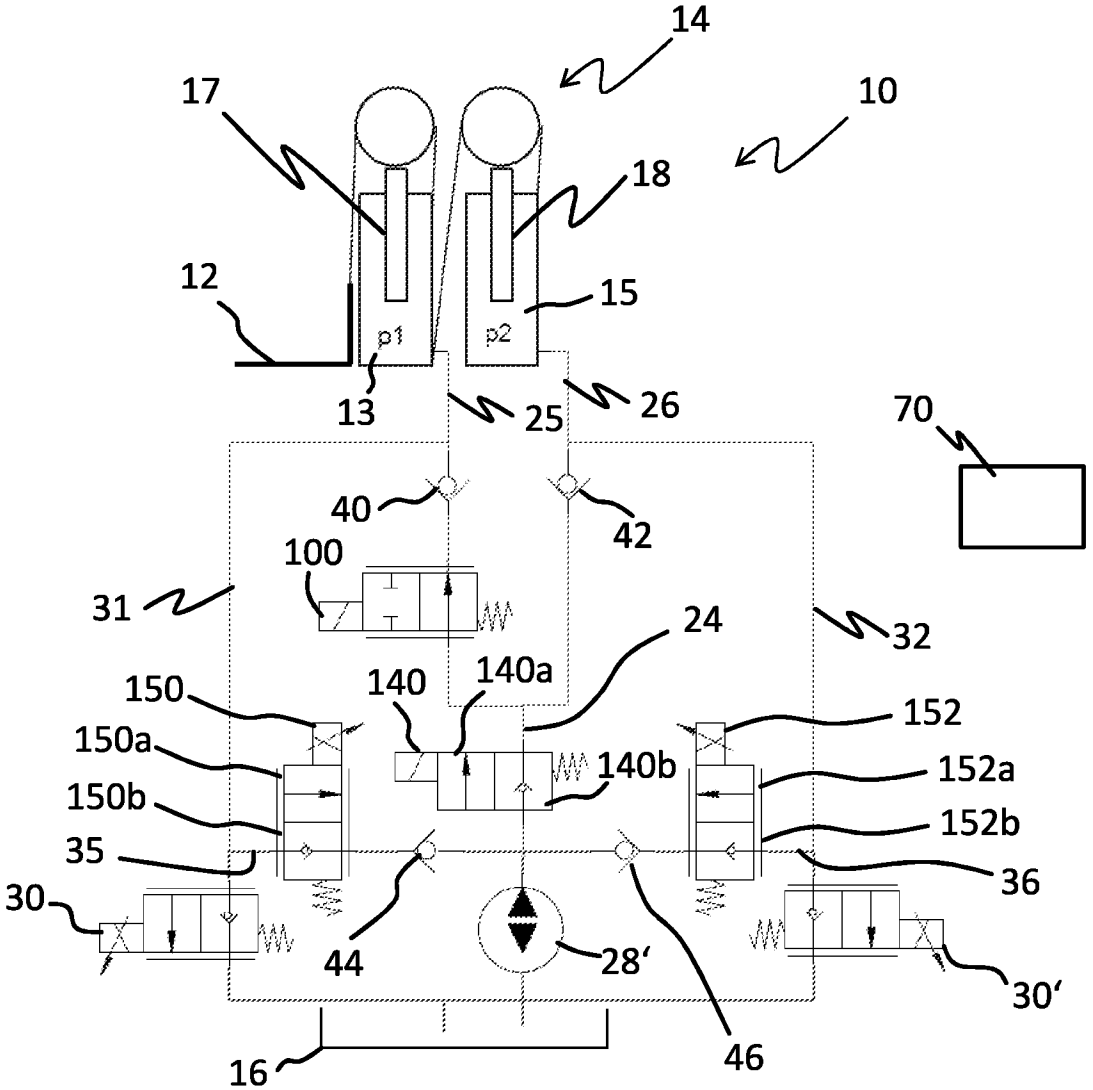
FIG. 10 illustrates another embodiment of the lifting device.

Referring to the embodiment of the lifting device shown in FIG. 10, a 2/2 way valve 140 is arranged in the lift branch upstream of the division of the supply line 24 into the first and second connecting lines 25, 26. Two recirculation valves 150, 152, are configured as 2/2-way proportional valves arranged in return lines 35, 36 leading to the hydraulic pump 28', by virtue of two check valves 44, 46. The two check valves 44, 46 are each arranged in one of the return lines 35, 36 and the hydraulic pump 28' can also function regeneratively.

The lifting process takes place here as with the lifting device according to FIG. 6, wherein the supply line 24 must first be unblocked by the 2/2-way valve 140. The 2/2-way valve 140 assumes its flow-through position 140*b* here. The check valves 44, 46 can prevent the flow of hydraulic fluid to the valves 150, 152.

During the lowering process, however, the embodiment of FIG. 10 includes the possibility of driving the hydraulic pump 28, which in this case functions generatively, with the hydraulic fluid that is flowing back to the hydraulic tank 16. To do so, the hydraulic fluid is not conducted via the recirculation valves 30, 30' to the hydraulic tank 16 from the free lift cylinder 13 and/or from the mast lift cylinder 15 during the lowering process. Instead, the hydraulic fluid is recirculated from the free lift cylinder 13 to the hydraulic pump 28' via the return lines 31, 35 through the recirculation valve 150, which is now in the flow-through position 150*a*, and through the check valve 44. The recirculation of hydraulic fluid from the mast lift cylinder 15 to the pump 28' similarly occurs via the return lines 32, 36 through the recirculation valve 152, which is now in the flow-through position 152*a*, and through the check valve 46. The hydraulic pump 28' is driven by the recirculated fluid. If the hydraulic pump 28' is not operating generatively, the recirculation valves 150, 152 are switched to their blocked positions 150*b*, 152*b*, and the recirculation occurs via the recirculation valves 30, 30' directly to the hydraulic tank 16 in the manner already described.

Figure 11:
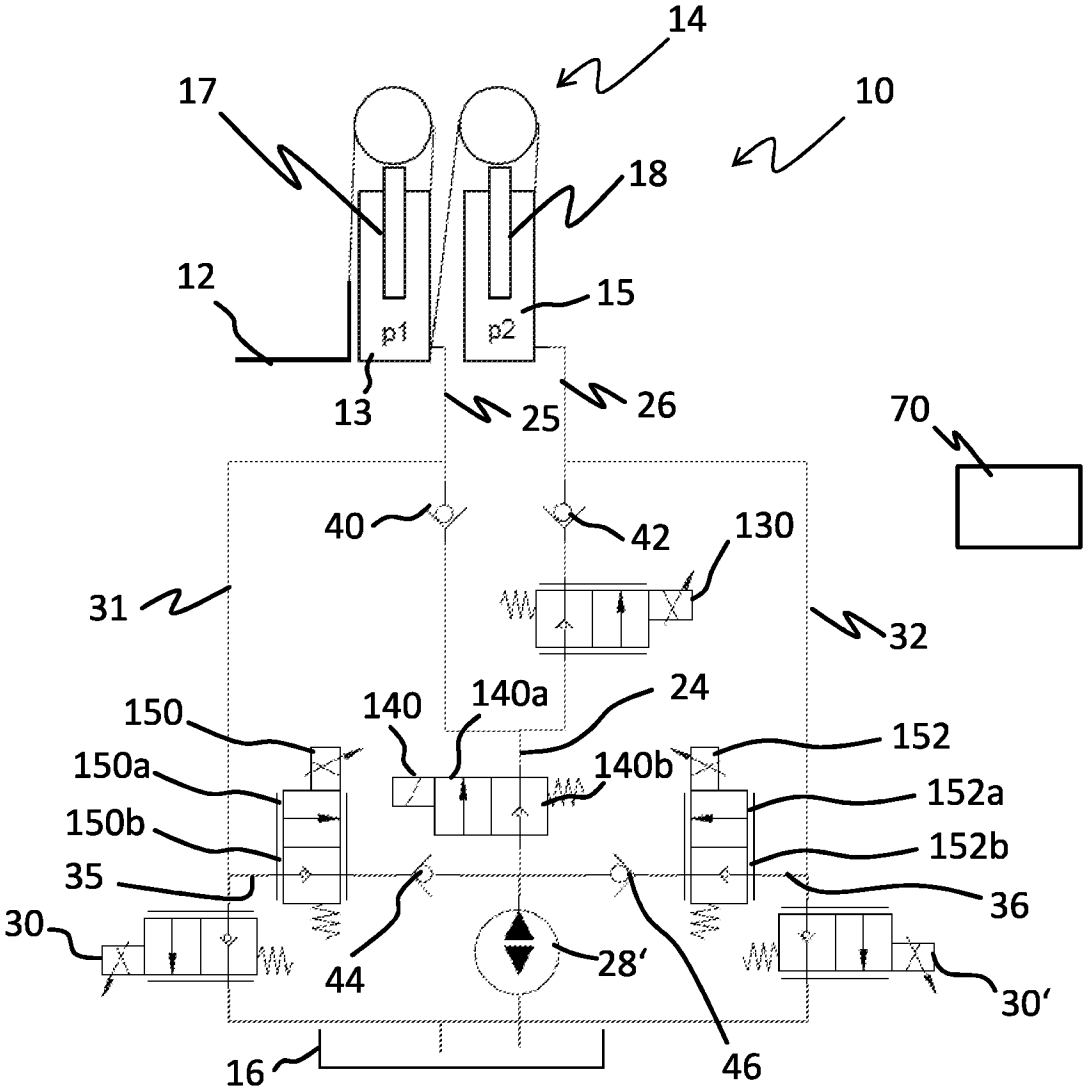
FIG. 11 illustrates a further embodiment of the lifting device.

Referring to the embodiment of the lifting device illustrated in FIG. 11, a 2/2-way proportional valve 130 is provided in connecting line 26, which leads to the mast lift cylinder 15, instead of in the first connecting line 25. This corresponds to the embodiment illustrated in FIG. 9 with the additional features of the embodiment of FIG. 10, which aid in the generative operation. Accordingly, generative operation of the hydraulic pump 28' is possible in this embodiment in a similar manner as was described above.

The invention claimed is:

1. A lifting device for an industrial truck comprising:

a lift frame comprising a load carrier and at least one mast stage, wherein the load carrier and the at least one mast stage are moveably guided;

a free lift cylinder configured to actuate the load carrier;

at least one mast lift cylinder configured to actuate the at least one mast stage;

a hydraulic assembly comprising a hydraulic tank and configured to provide the free lift cylinder and the at least one mast lift cylinder with hydraulic fluid from the hydraulic tank;

only one delivery valve connected to the hydraulic assembly and to at least one of the free lift cylinder and the at least one mast lift cylinder, wherein the only one delivery valve is configured to supply hydraulic fluid from the hydraulic tank to at least one of the free lift cylinder and the mast lift cylinder;

at least one recirculation valve connected to the hydraulic assembly and to at least one of the free lift cylinder and the at least one mast lift cylinder, wherein the at least one recirculation valve is configured to recirculate hydraulic fluid from at least one of the free lift cylinder and the mast lift cylinder to the hydraulic tank;

a supply line connected to the hydraulic assembly;

a first connecting line connected to the free lift cylinder; and a second connecting line connected to the at least one mast cylinder, wherein the only one delivery valve is positioned in one of the first connecting line and the second connecting line, wherein a first pressure is required to actuate the free lift cylinder and a second pressure is required to actuate the mast lift cylinder, wherein the first pressure is lower than the second pressure when the only one delivery valve is positioned in the first connecting line, and wherein the first pressure is higher than the second pressure when the only one delivery valve is positioned in the second connecting line, and wherein the only one delivery valve is configured to move between a blocked position and a flow-through position, and wherein the first pressure and the second pressure are adjusted through the movement of the only one delivery valve between the blocked position and the flow-through position.

2. The lifting device according to claim 1, wherein the only one delivery valve further comprises a proportional valve.

3. The lifting device according to claim 2, wherein the proportional valve comprises one of a 3/2 and a 2/2 proportional valve.

4. The lifting device of claim 1, wherein the at least one recirculation valve further comprises a proportional valve.

5. The lifting device according to claim 1, wherein the at least one recirculation valve connects to a first return line and a second return line to the hydraulic assembly independently of the at least one delivery valve.

6. The lifting device according to claim 5, wherein the first return line and the second return line are merged into a common third return line.

7. The lifting device according to claim 5, wherein the at least one recirculation valve comprises a recycling 3/2-way proportional valve, and wherein the first return line and the second return line are merged into a common third return line.

8. The lifting device according to claim 5, further comprising a 4/2-way proportional valve configured to selectively separate the first return line and the second return line from the at least one recirculation valve, wherein the at least one recirculation valve is a recirculating 3/2-way proportional valve.

9. The lifting device according to claim 5, further comprising a 4/2 way proportional valve configured to selectively connect the first return line and the second return line to the at least one recirculation valve, wherein the at least one recirculation valve is a recycling 3/2-way proportional valve.

10. The lifting device according to claim 5, wherein the first connecting line comprises a first check valve disposed between the at least one delivery valve and a branch connection of the first return line from the first connecting line and the second connecting line comprises a second check valve disposed between the delivery valve and a branch connection of the second return line from the second connecting line.

11. The lifting device according to claim 1, wherein the hydraulic assembly further comprises a hydraulic pump that is configured to conduct the hydraulic fluid out of the hydraulic tank via the supply line.

12. The lifting device according to claim 1, wherein at least one of the supply line comprises an isolation valve configured to separate hydraulic flow from the hydraulic assembly to the at least one delivery valve.

13. The lifting device according to claim 1, further comprising a control unit configured to actuate at least one of the only one delivery valve and the at least one recirculation valve.

14. The lifting device according to claim 13, wherein at least one of the free lift cylinder and the mast lift cylinder further comprises a sensor configured to communicate with the control unit to determine a lifting height, a lifting speed, and a lowering speed of the load carrier.

15. The lifting device according to claim 14, wherein the control unit is configured to activate the only one delivery valve and the at least one recirculation valve in order to control the lifting speed and lowering speed of the load carrier.

16. The lifting device according to claim 14, wherein the control unit is configured to, activate the only one delivery valve and wherein the only one delivery valve is configured to adjust a target lifting speed, activate the recirculation valve to set a target lowering speed of at least one of the load carrier and the at least one mast stage, calculate a control deviation between the target lifting speed and actual lifting speed detected by the sensor and between the target lowering speed and actual lowering speed detected by the sensor, and activate at least one of the only one delivery valve and the at least one recirculation valve to control a supply of hydraulic fluid to at least one of the free lift cylinder and mast lift cylinder based on the calculated control deviation.

* * * * *